US012421975B1

(12) United States Patent
Botkin et al.

(10) Patent No.: US 12,421,975 B1
(45) **Date of Patent: *Sep. 23, 2025**

(54) CEILING FAN WITH QUICK-CONNECT BLADE CONNECTOR

(71) Applicant: Hunter Fan Company, Memphis, TN (US)

(72) Inventors: Charles William Botkin, Cordova, TN (US); Rickey Thomas Jones, Memphis, TN (US); Douglas Troy Mason, Horn Lake, MS (US)

(73) Assignee: Hunter Fan Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/058,077

(22) Filed: Feb. 20, 2025

Related U.S. Application Data

(63) Continuation of application No. 18/797,889, filed on Aug. 8, 2024, now Pat. No. 12,264,686.

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 25/088; F04D 29/34
See application file for complete search history.

(56) References Cited

U.S. PATENT DOCUMENTS

| | | | |
|---|---|---|---|
| 6,059,531 | A | 5/2000 | Tai |
| 6,726,453 | B1 | 4/2004 | Hsieh |
| 6,916,156 | B2 | 7/2005 | Tseng |
| 7,134,844 | B2 | 11/2006 | Robin |
| 10,502,228 | B2 | 12/2019 | Zauhar |
| 10,578,121 | B2 | 3/2020 | Tang |
| 11,686,322 | B1 | 6/2023 | Yao |
| 11,761,454 | B2 | 9/2023 | Yao |
| 2012/0266510 | A1 | 10/2012 | Kokenes |
| 2015/0300364 | A1 | 10/2015 | Lin |
| 2019/0145424 | A1 | 5/2019 | Tai |
| 2023/0235749 | A1 | 7/2023 | Yao |

FOREIGN PATENT DOCUMENTS

| | | | |
|---|---|---|---|
| AU | 2018247367 | A1 | 4/2020 |
| CN | 105782114 | B | 7/2016 |

*Primary Examiner* — Courtney D Heinle
*Assistant Examiner* — John S Hunter, Jr.
(74) *Attorney, Agent, or Firm* — McGarry Bair PC

(57) ABSTRACT

A ceiling fan assembly for mounting to a structure, the ceiling fan assembly comprising: a motor having a rotor assembly, which rotates about a rotational axis, and a stator assembly that is stationary relative to the rotational axis; at least one blade assembly having a root assembly; and a connector assembly comprising: a pocket carried by the rotor assembly, a tab carried by the at least one blade assembly and received within the pocket, and a tensioner to secure the tab within the pocket.

27 Claims, 16 Drawing Sheets

CEILING FAN WITH QUICK-CONNECT BLADE CONNECTOR

CROSS-REFERENCE TO RELATED APPLICATION

This application is a continuation application of U.S. patent application Ser. No. 18/797,889, filed Aug. 8, 2024, now allowed, which is hereby incorporated herein by reference in its entirety.

BACKGROUND

Ceiling fans are used to generate airflow within a space or area and are often used for cooling or temperature regulation. Ceiling fans can be used in industrial, commercial, farming, or residential environments to circulate air to maintain proper temperature regulation.

Ceiling fans typically include a motor housing that is attached to a structure using a suitable mounting bracket that is typically hidden with a canopy. The motor housing has a rotating portion to which multiple blades are attached. The blade can be directly attached to the rotating portion or indirectly attached such as through a blade iron or similar element. Optional light assemblies can be attached to the motor housing and are typically attached to a non-rotating portion of the motor housing. The blades are attached to the blade irons using suitable fasteners.

Electrical components, such as power supply circuits, motor control circuits, and communication circuits, are typically located within the motor housing and/or the light assembly. Alternatively, some of the electrical components and electrical connectors can be located or made in the mounting bracket and hidden by the canopy.

BRIEF DESCRIPTION

One aspect of the follow description relates to A ceiling fan assembly for mounting to a structure, the ceiling fan assembly comprising: a motor having a rotor assembly, which rotates about a rotational axis, and a stator assembly that is stationary relative to the rotational axis; at least one blade assembly having a root assembly; and a connector assembly comprising: a pocket located within the rotor assembly, a tab carried by the at least one blade assembly and received within the pocket, a first ramp and a second ramp in opposing relation within the pocket to define a throat within the pocket, with the throat oriented at an angle relative to the pocket, a first tensioner and a second tensioner in opposition relative to the pocket and bearing against the tab, when it is received within the pocket, such that the first tensioner applies a first pressure to the tab and the second tensioner applies a second pressure to the tab.

BRIEF DESCRIPTION OF THE DRAWINGS

In the drawings:

FIG. 13A shows the relative position along a section line passing through an upper spring finger. FIG. 13B shows the relative position along a section line passing through an upper guide element. FIG. 13C shows a top view.

DETAILED DESCRIPTION

The disclosure herein is directed to systems, methods, and other devices related to an apparatus and methods for attaching and detaching blades to a rotor assembly of a ceiling fan assembly. Since more and more consumers assemble and install their own ceiling fan, instead of relying on a professional installer, various structures or systems have been developed for simplifying the assembly and installation, including blade assembly (blade, blade iron, or combination of both) attachment mechanisms. A subset of blade assembly attachment mechanisms is referred to as quick connect assemblies, quick connect mechanisms, quick connect systems or the like and do not require tools for attachment of the blade assembly to the rotor assembly of the ceiling fan. Often such quick connect assemblies are in the form of a receptacle in the rotor assembly that receives and secures a portion, such as a tab of the blade assembly. A subset of the quick connect assemblies is a snap-fit or snap-lock system, which generates tactile feedback, such as sound, a feel, or both, when the blade assembly is properly secured to the rotor assembly.

Current quick connect assemblies tend to sufficiently secure the blade assembly to the rotor assembly such that there is no concern the blade assembly will separate from the rotor assembly during operation. However, to make easy the insertion of the tab into the receptacle, tolerances are designed into the tab and the receptacle. These tolerances can be great enough such that a sufficient amount of "slop" is present for there to be relative movements, all be it typically small movements, between the tab and the receptacle. These small movements can create noise during rotation of the fan and the noise can be undesirable to consumers.

This disclosure focuses on a fan assembly having a quick connect assembly that is easy and quick for a consumer to install the blade assembly to the rotor assembly in a manner that operationally secures the blade assembly to the rotor assembly while eliminating most or all of the operational noise discernable by humans associated with movement of the blade assembly relative to the receptacle. The solution includes the addition of one or more tensioners to the rotor assembly or blade assembly to maintain the tab and receptacle under relative tension during rotation and, optionally, when not rotating. The presence of the tension force associated with the tensioners inhibits the relative motion between the receptacle and tab and thereby eliminates noise associated with the relative movement.

Figure 1:
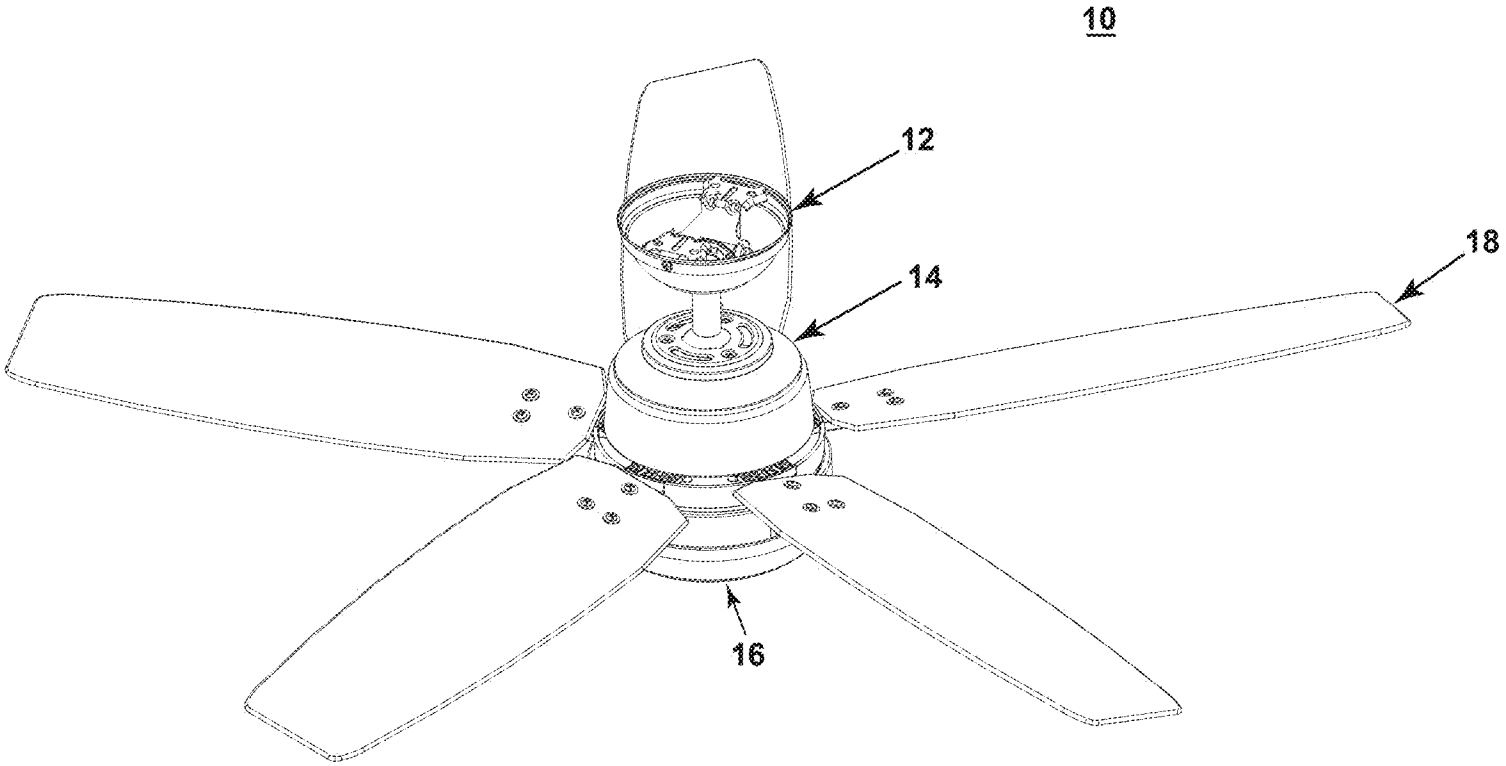
FIG. 1 is a top perspective view of a ceiling fan assembly with multiple blade connectors according to the description.

FIG. 1 illustrates a ceiling fan assembly 10 incorporating a quick connect assembly. The major elements of the ceiling fan assembly 10 include a mounting assembly 12, motor assembly 14, light assembly 16, and blade assembly 18. The light assembly 16 is optional and is not germane to the disclosure. It is worth noting that any suitable light assembly 16 may be used. Therefore, only a minimal description of the light assembly 16 is provided.

Figure 2:
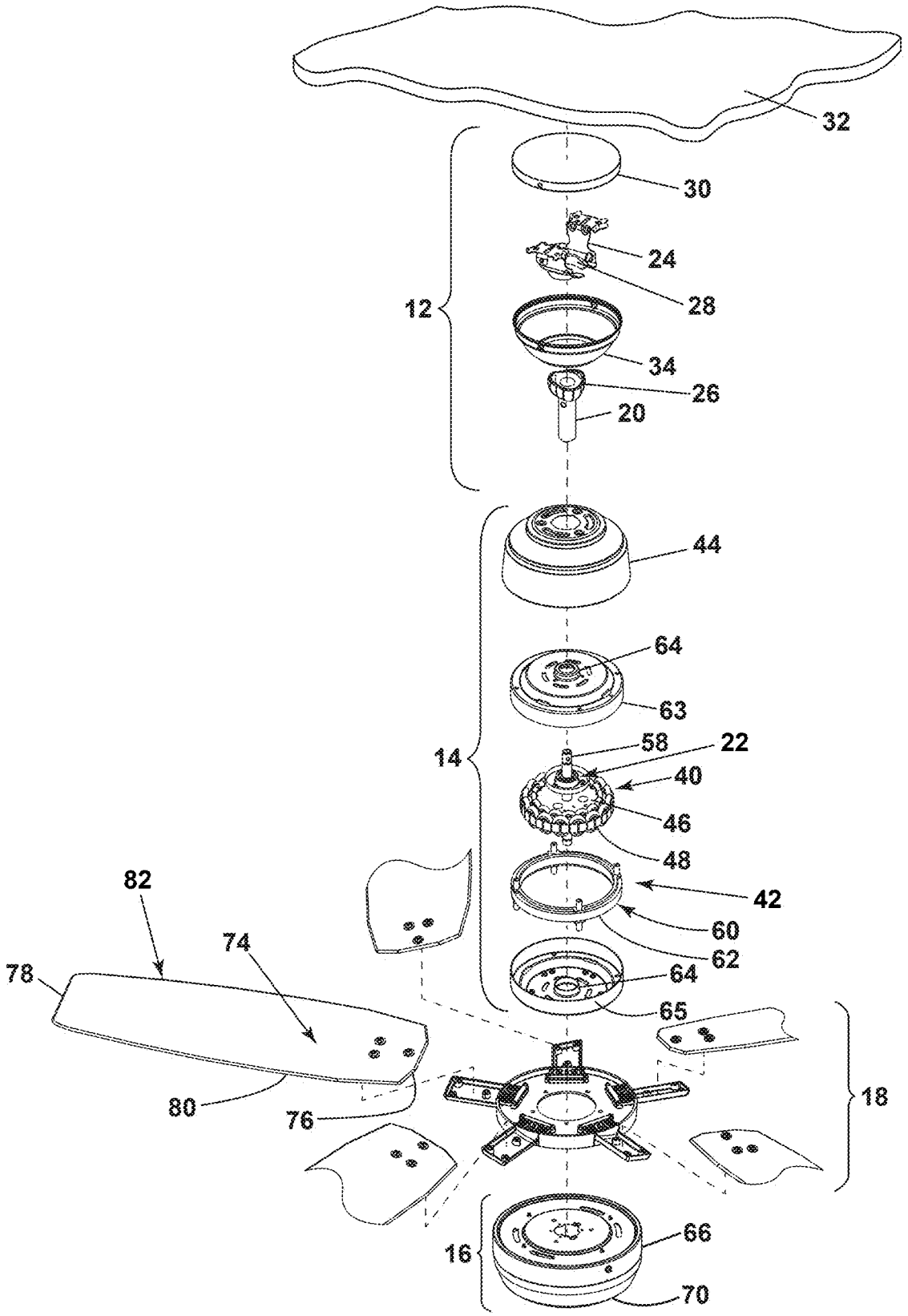
FIG. 2 is an exploded perspective view of the ceiling fan of FIG. 1 and illustrating the major components of the ceiling fan including mounting assembly, motor assembly, blade assembly, and light assembly.

Referring to FIG. 2, an exploded view of the ceiling fan assembly 10 is shown to better illustrate the elements of the different assemblies. The mounting assembly 12 is illustrated as having a downrod 20 coupled at one end to a motor adapter 22 by suitable fasteners or the threading of a tapped end of the downrod 20 into a tapped opening in the motor adapter 22. Another end of the downrod 20 is secured to a hanger bracket 24 by a hanger ball 26 affixed to an end of the downrod 20. The hanger bracket 24 includes a seat 28 in which the hanger ball 26 is received. A mounting plate 30 secures the hanger bracket 24 to a suitable structure 32, such as a ceiling or wall, by fasteners (not shown) passing through openings in the mounting plate 30 and into the structure 32. A canopy 34 can be provided as a decorative cover. The canopy 34 can mount to either the downrod 20, hanger bracket 24, or mounting plate 30 and hides from view the hanger bracket 24 and at least a major portion of the hanger ball 26. The downrod 20 can be hollow such that electrical wiring, for providing power or data, can extend through the downrod 20 and to the motor assembly 14. In most installations, the electrical connection between the household power supply and the ceiling fan assembly 10 is hardwired and located in the interior of the hanger bracket 24. Thus, the canopy 34 hides the hardwired connection from view.

The motor assembly 14 comprises a stator assembly 40 and rotor assembly 42, which are enclosed by a motor housing 44. The stator assembly 40 includes a stator 46 formed from multiple wire coils 48 wrapped around arms of a stator core, with the coils 48 forming the magnetic poles for the stator 46. The stator core can be made from a plurality of stacked laminations or machined from solid material. A non-rotating motor shaft 58 receives and supports the stator core as well as being connected, directly to the downrod 20 or indirectly via a motor adapter 22. The non-rotating motor shaft 58 can be hollow to permit electricity and data lines to pass through, especially to provide power/data to the light assembly 16.

The rotor assembly 42 includes a rotor 60 carrying a plurality of laminations 62, which define the magnetic poles for the rotor assembly 42. One or more bearings 64 carried by the non-rotating motor shaft 58 rotationally secures the rotor 60 thereby permitting rotation of the rotor 60 relative to the stator 46. The rotor 60 is illustrated in the form of an upper/lower housing 63, 65, which carry the laminations 62 while also serving to cover the stator 46.

The light assembly 16 comprises a light housing 66 that is secured to the stator assembly 40. As illustrated, the light housing 66 is secured to a lower portion of the non-rotating motor shaft 58. It is possible for the light assembly 16 to be secured to the rotor assembly 42. However, this introduces additional complexity and can result in moving shadows cast by the rotating light, which is not desirable for most consumers. An illumination source (not shown), such as one or more LEDs are located within the light housing and supplied electricity by an electrical lead passing through the non-rotating motor shaft 58. A lens or globe 70 can close a lower, open end of the light housing 66.

The blade assemblies 18 include a plurality of blades 74, with each blade 74 extending between a root 76 and a tip 78, in a span-wise direction, and between a leading edge 80 and trailing edge 82, in a chord-wise direction. Each blade 74 can be made of a single piece or of multiple elements.

Figure 3:
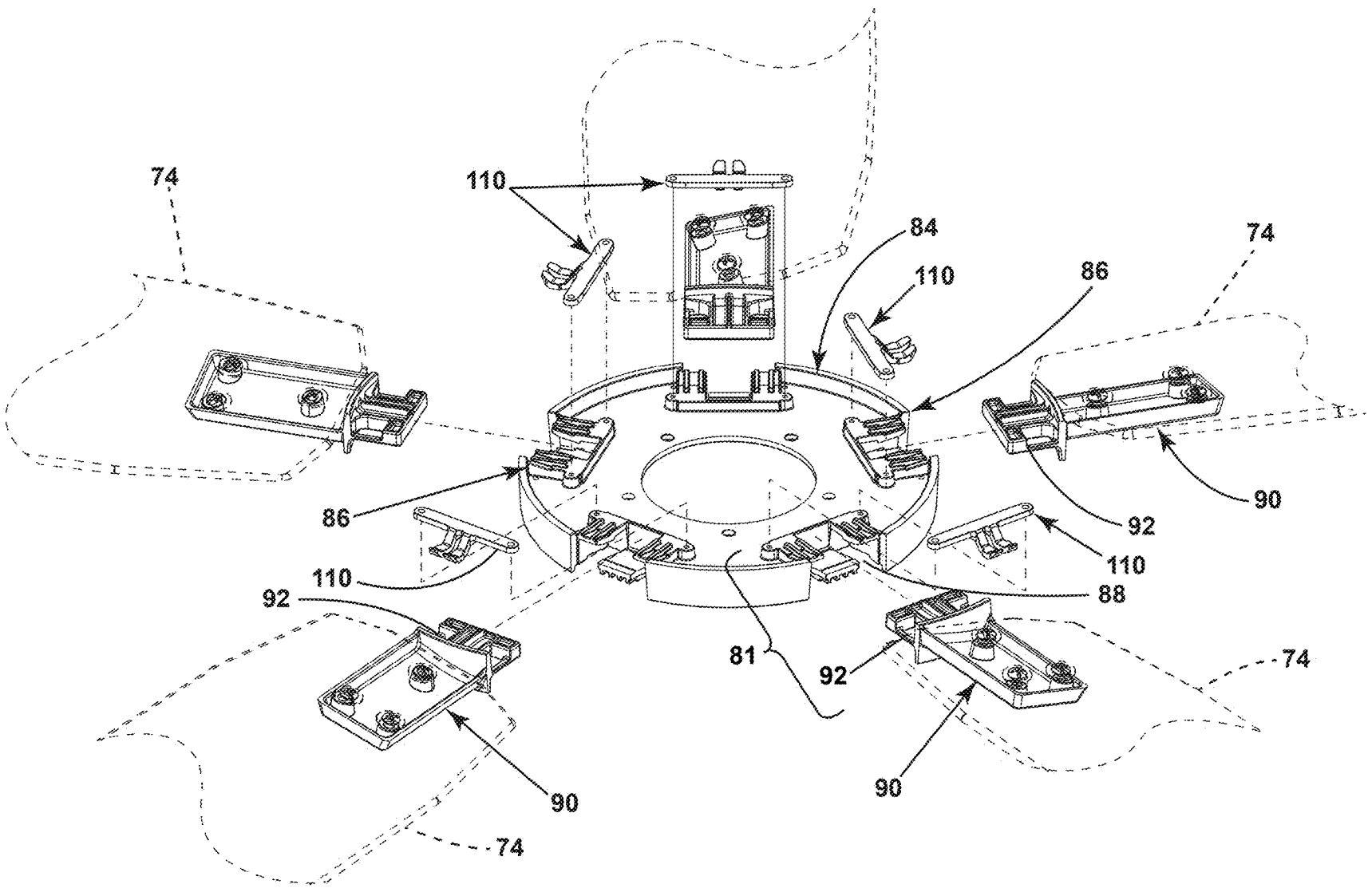
FIG. 3 is an exploded perspective view of blade assembly of FIG. 2, which collectively form a connector assembly to secure the blade assembly to the rotor assembly, with only a portion of the blade body being shown in dashed line for clarity.

Referring to FIG. 3, a connector assembly 81 connects the blades 74 to the rotor assembly 42. As illustrated the connector assembly 81 includes a pocket housing 84 defining multiple, radially spaced pockets 86 with an insert slot 88. The pocket housing 84 is illustrated as being mechanically secured to the rotor assembly 42 but could just as easily be integrated with the rotor 60. The connector assembly 81 further includes a root assembly 90 affixed to the root 76 of each blade 74. The root assembly 90 can be separate from or integrated with the blade 74. The root assembly 90 comprises a tab 92 that is inserted in the slot 88 and received within a corresponding pocket 86. As illustrated, the pocket 86 and corresponding tab 92 form a snap-fit connector to secure a blade to the rotor, but the connection need not be a snap-fit connector.

Figure 4:
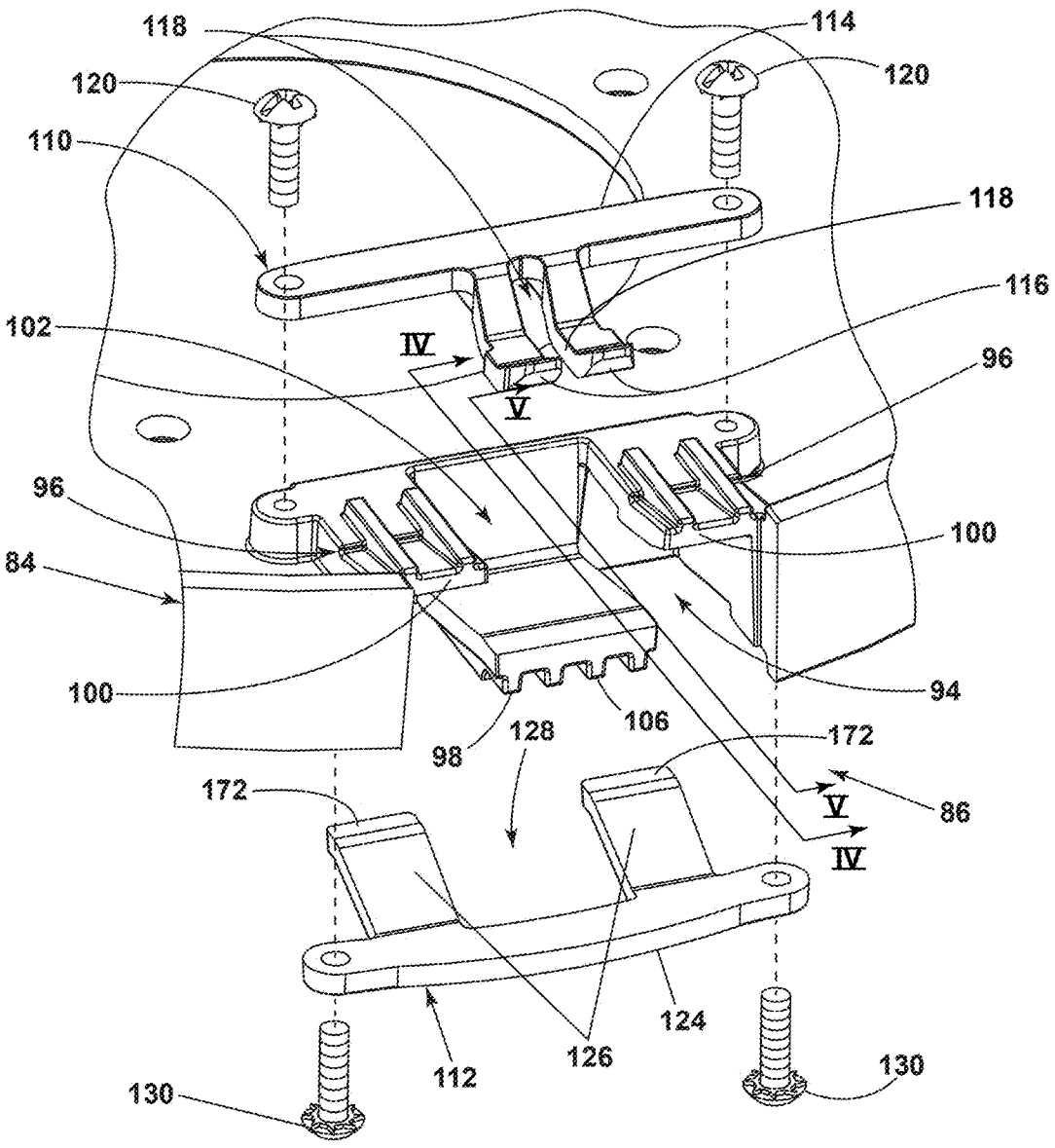
FIG. 4 is an exploded view of a pocket housing of the connector assembly and illustrating first and second tensioners.

Referring to FIG. 4, each of the pockets 86 comprise a recess 94 formed in the pocket housing 84. First and second guide elements 96, 98 project into or overly a portion of the recess 94. The first and second guide elements 96, 98 are in confronting relationship. While it need not be the case, as illustrated, the recess defines the maximum extent of the pocket 86, with the first and second guide elements 96, 98 defining upper and lower extents of the pocket 86. The first guide element 96 is arranged as two laterally spaced upper fingers 100, which define an intervening finger gap 102. The second guide element 98 is arranged as a single lower finger 104, which is in vertical registry with the finger gap 102. It is contemplated that the upper/lower fingers could be switched in vertical position and/or the number of fingers can vary for each. As illustrated the upper/lower fingers are not intended to be inherently resilient, although they can have some resiliency and in some cases could be designed with resiliency. Strengthening ribs 106 are located on the outer surfaces of the first and second guide elements 96, 98.

First and second tensioners 110, 112 are mounted in confronting relationship relative to the pocket 86. The first tensioner 110 comprises a first carrier 114 from which extend a pair of spaced first spring fingers 116, which are separated by an alignment channel 118. The carrier 114 is secured by suitable fasteners 120 to the pocket housing 84. The second tensioner 112 comprises a second carrier 124 from which extends a second pair of spaced second spring fingers 126, which define an intervening spring finger gap 128. The second carrier 124 is secured to the pocket housing 84 by suitable fasteners 130 and the spring finger gap 128 is in vertical registry with the first spring fingers 116.

Figure 5:
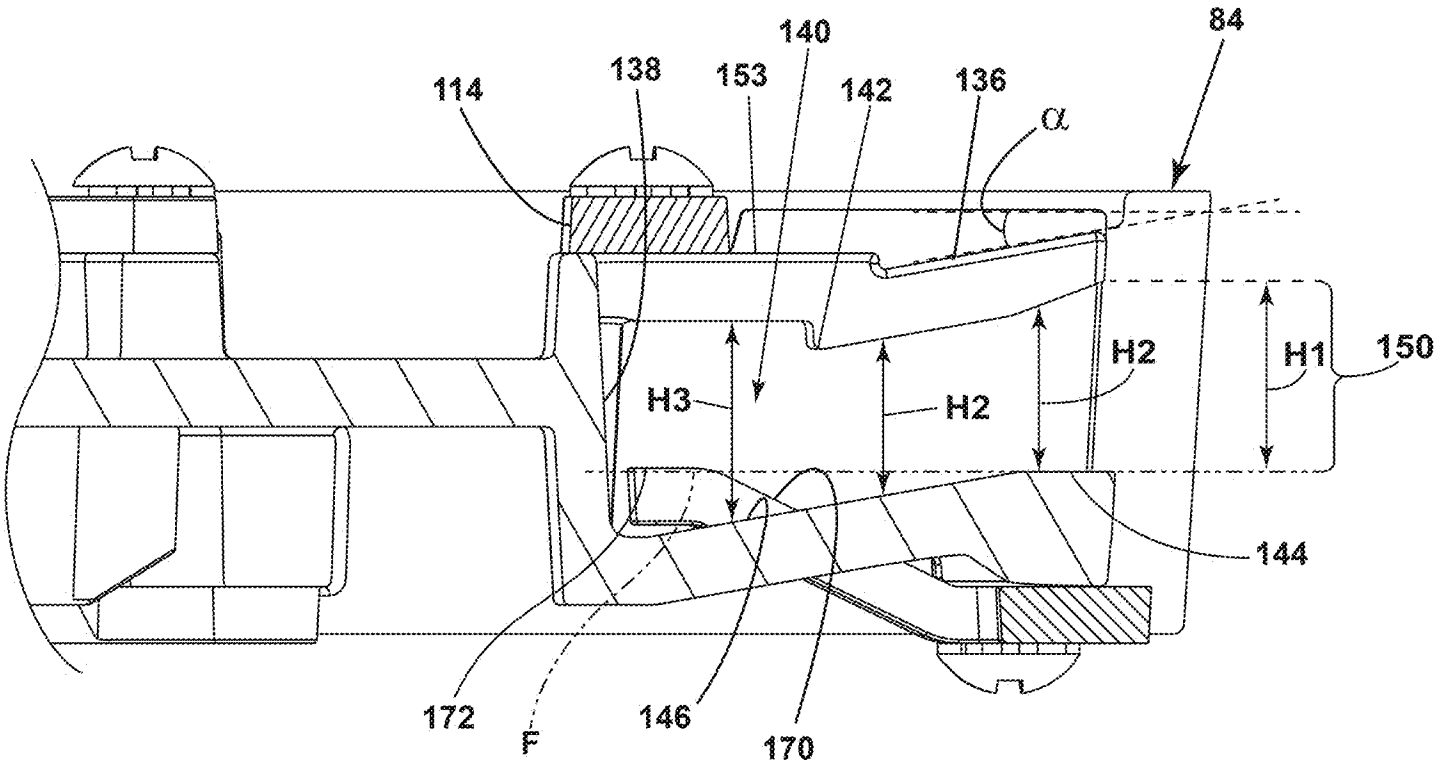
FIG. 5. is a section view of taken along line V-V of FIG. 4 and illustrates first and second guide elements associated with a pocket in the pocket housing.

Referring to FIG. 5, the details of the first and second guide elements 96, 98 can be better seen and understood.

Each of the first guide elements 96, 98 comprise a first ramp 136, with the first ramp 136 being at an angle, alpha, relative to the horizontal. The angle alpha is referenced to a horizontal line for convenience but could be referenced to any other suitable reference such as a plane perpendicular to the axis of rotation of the fan assembly. The first ramp 136 terminates short of a rear 138 of the pocket 86 to define a notch 140, with a terminal end 142 of the first ramp 136 defining a lip confronting the notch 140.

The second guide element 98 comprises a landing 144 followed by a second ramp 146, which is illustrated as extending to the rear 138 of the pocket 86. As illustrated, the landing 144 begins axially slightly outboard of the first ramp 136 and axially terminates before the terminal end 142. The second ramp 146 is generally of the same angle, alpha, as the first ramp 136.

The first ramp 136 and landing 144 define an effective mouth 150 to the slot 88 that reduces in height from H1 to H2 at the end of the landing 144. The first and second ramps 136, 146 continue from the mouth 150 to define a throat 152 to the slot 88 of a constant height H2, albeit sloped along the angle alpha to the notch 140. The notch 140 is defined by a horizontal upper wall 153 and a confronting portion of the second ramp 146. The height H3 of the notch increases from H2 in a direction toward the rear 138 of the pocket 86 beginning at the terminal end 142.

Figure 6:
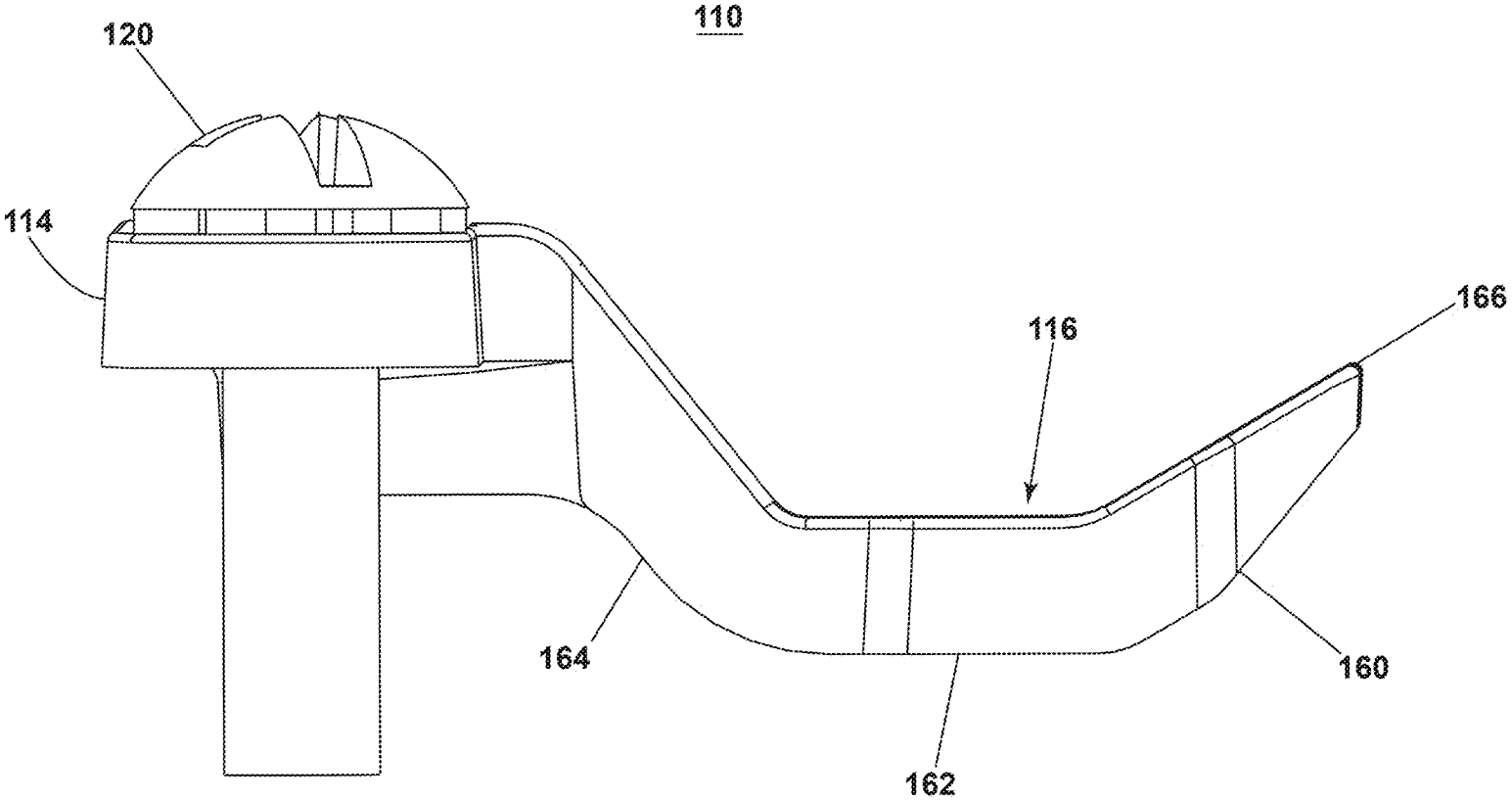
FIG. 6 is a side view of the first tensioner.

Referring to FIG. 6, the first spring fingers 116 of the first tensioner 110 comprise a first ramp segment 160, a plateau segment 162, and a second ramp segment 164. The first ramp segment 160 angles downwardly from the carrier to the plateau segment 162. The second ramp segment 164 angles upwardly from the plateau segment 162. The second ramp segment 164 tapers in thickness from the plateau segment 162 to a spring fingertip 166.

Figure 7:
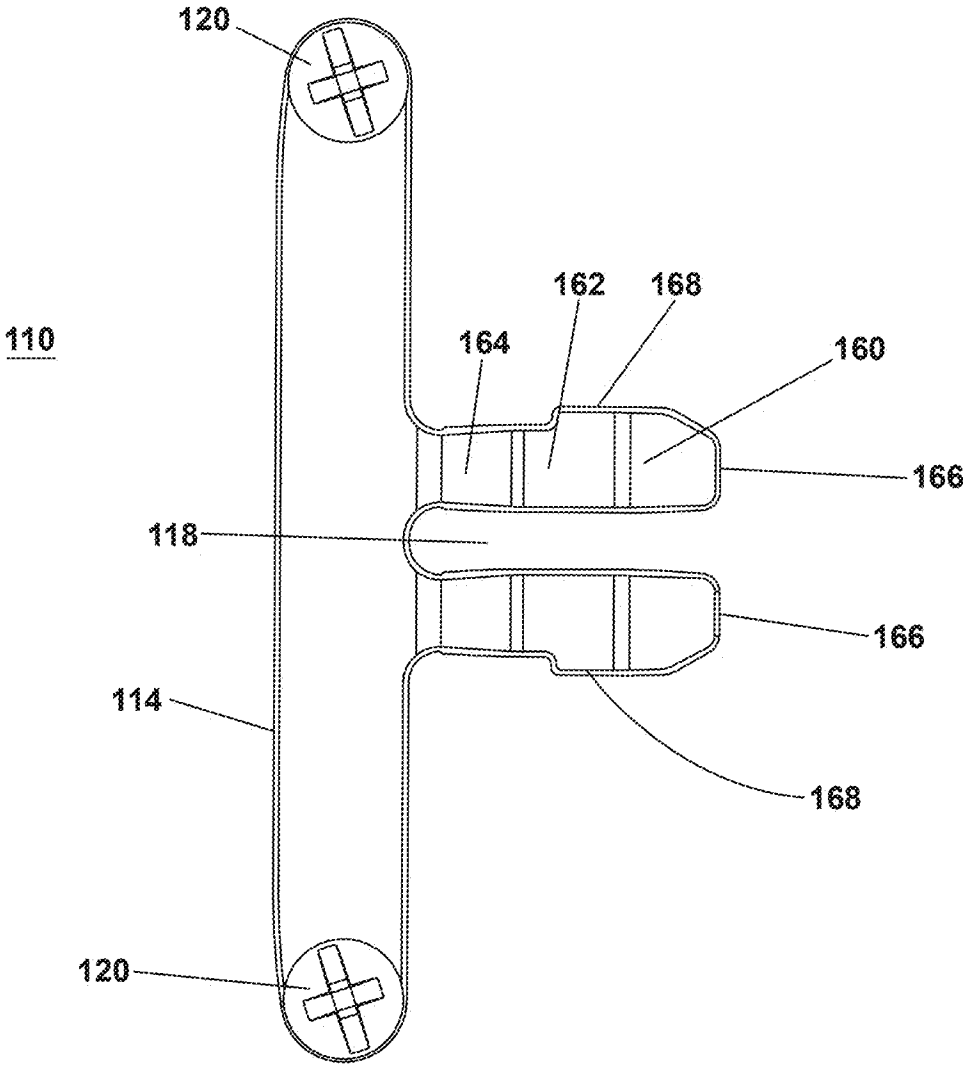
FIG. 7 is a top view of the first tensioner.

Referring to FIG. 7, the first spring fingers 116 have a lateral extension 168 that begins part way in the plateau segment 162 and extends part way into the second ramp 146. The lateral extension 168 provides a portion of the plateau segment 162 and the second ramp 146 with a greater width. The second ramp 146 tapers in width from the lateral extension to the tip 166.

Figure 8:
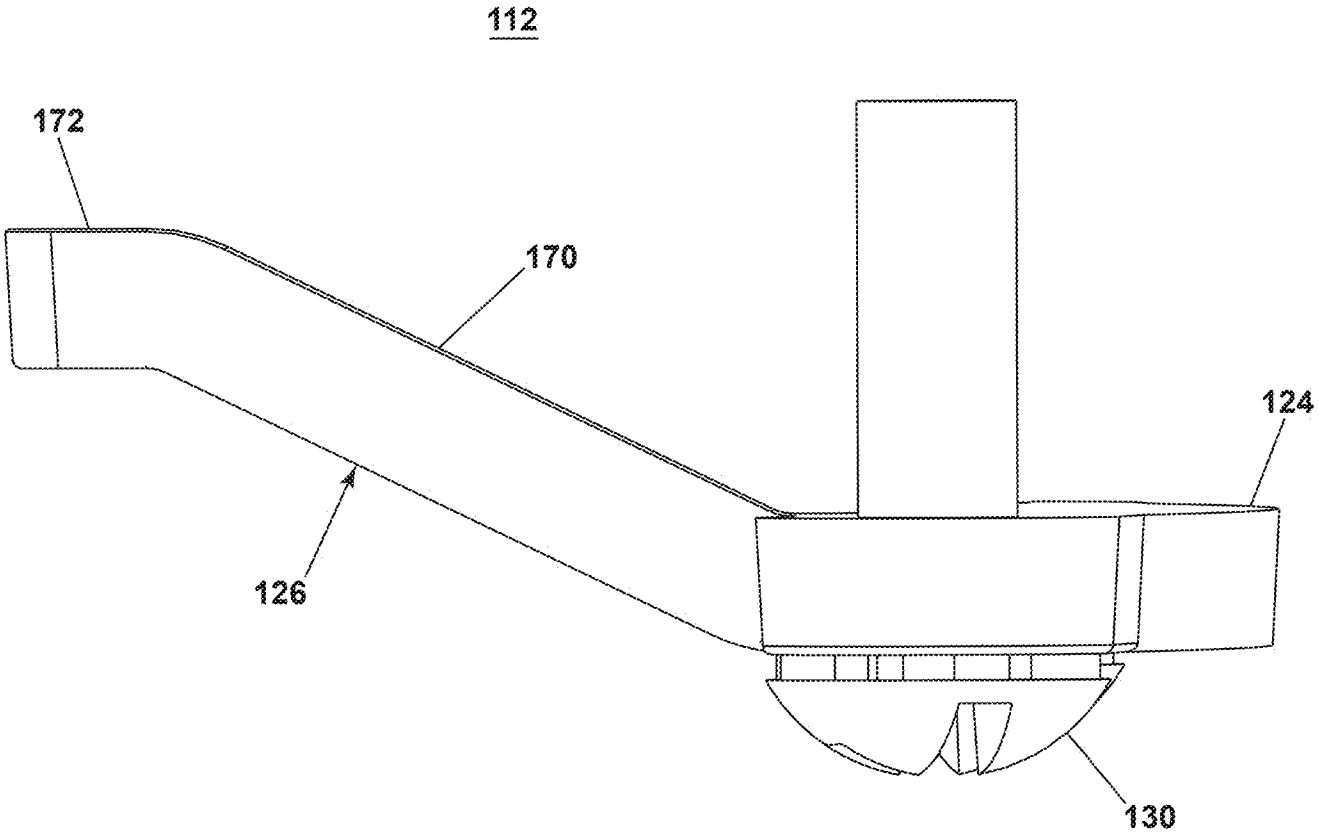
FIG. 8 is a side view of the second tensioner.

Referring to FIG. 8, the second spring fingers 126 of the second tensioner 112 comprise a third ramp segment 170 terminating in a second landing 172. The third ramp segment 170 is at essentially a complementary angle to the angle alpha.

Figure 9:
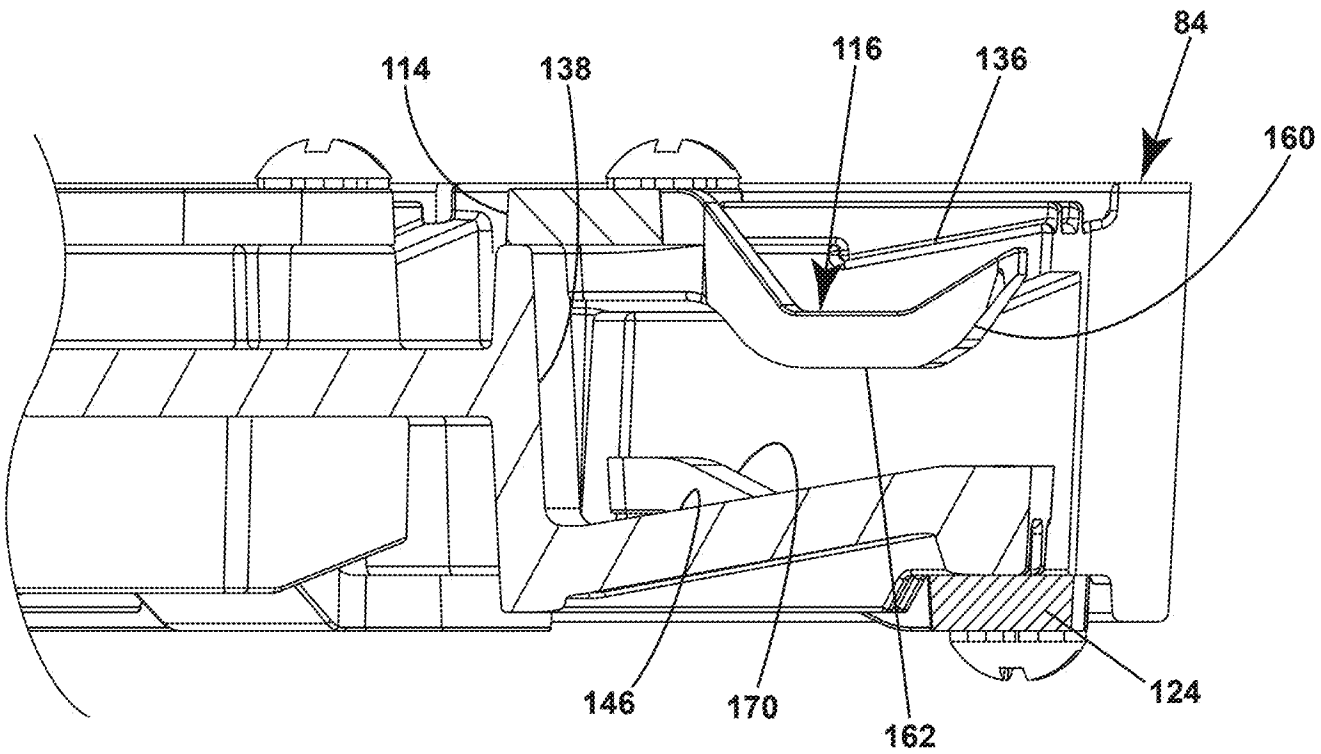
FIG. 9 is a section view taken along line IX-IX of FIG. 4 and illustrates the axial cross section of the pocket.

Referring to FIG. 9, the axial cross section of the pocket 86 is illustrated to better show the effective shape of the pocket 86 resulting from the presence of the first and second spring fingers 116, 126 and the first and second guide elements 96, 98. In this view, it is seen that the landings 144, 172 are at essentially the same relative height within the pocket 86 and define an effective floor, F, for the pocket 86. The mouth 150 of the pocket 86 has the height H1, which reduces to a height H2 at the throat 152 and relative to the floor, F. The height H2 stays essentially constant, relative to the floor, F, until the notch 140, when the height increases to H3. The first ramp segment 160 begins approximately at the mouth 150 and extends down into the pocket 86 to a height less than H2, thereby partially blocking the mouth 150. The plateau segment 162 is generally parallel to the floor F.

Figure 10:
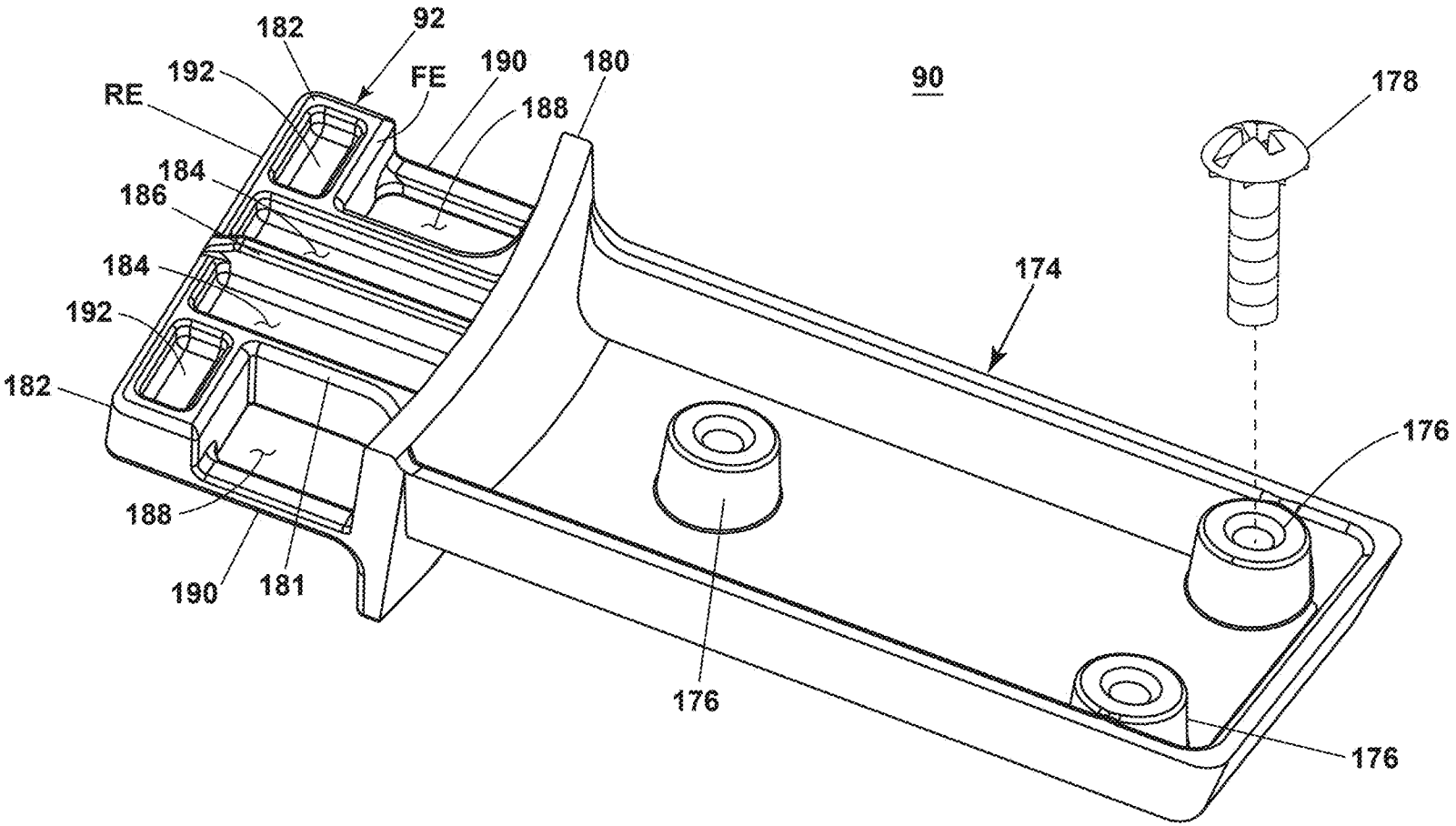
FIG. 10 is a perspective view of the root assembly.

Referring to FIG. 10, the root assembly 90 is shown in greater detail. The root assembly 90 comprises a blade iron 174 that terminates in the tab 92. The blade iron 174 has multiple embossments 176, which are tapped, and receive suitable fasteners 178, such as bolts, passing through grommets on the blade 74 and into embossments 176. The blade iron 174 terminates in a flange 180 from which the tab 92 extends. The flange 180 is largely ornamental and continues the outer, peripheral surface of the pocket 86 housing 84. Although, in some applications, the flange 180 can also provide a structural benefit in that it resists torsion forces that might lead to bending.

It should be noted that the blade iron 174 is just one mechanism by which the tab 92 can be affixed to the blade 74. The tab 92 could just as easily be integrally formed with the blade 74, such as a by the tab 92 being an end of a spar that extends from the root of the blade. Thus, while a blade iron 174 is described, it should not be considered limiting or required.

The tab 92, as illustrated, has a T-shape configuration formed by a central stem 181 from which laterally extend opposing leaves 182. The stem 181 extends from the flange 180 and has two parallel channels 184 separated by a stem rib 186. The leaves 182 are spaced from the flange 180 a sufficient distance to form corresponding tab openings 188. The tab openings 188 could just as easily be a recess instead of a complete through opening. Stringers 190 extend from the flange 180 to the leaves 182 to provide additional strength. A recess 192 is formed in each of the leaves 182.

Figure 11:
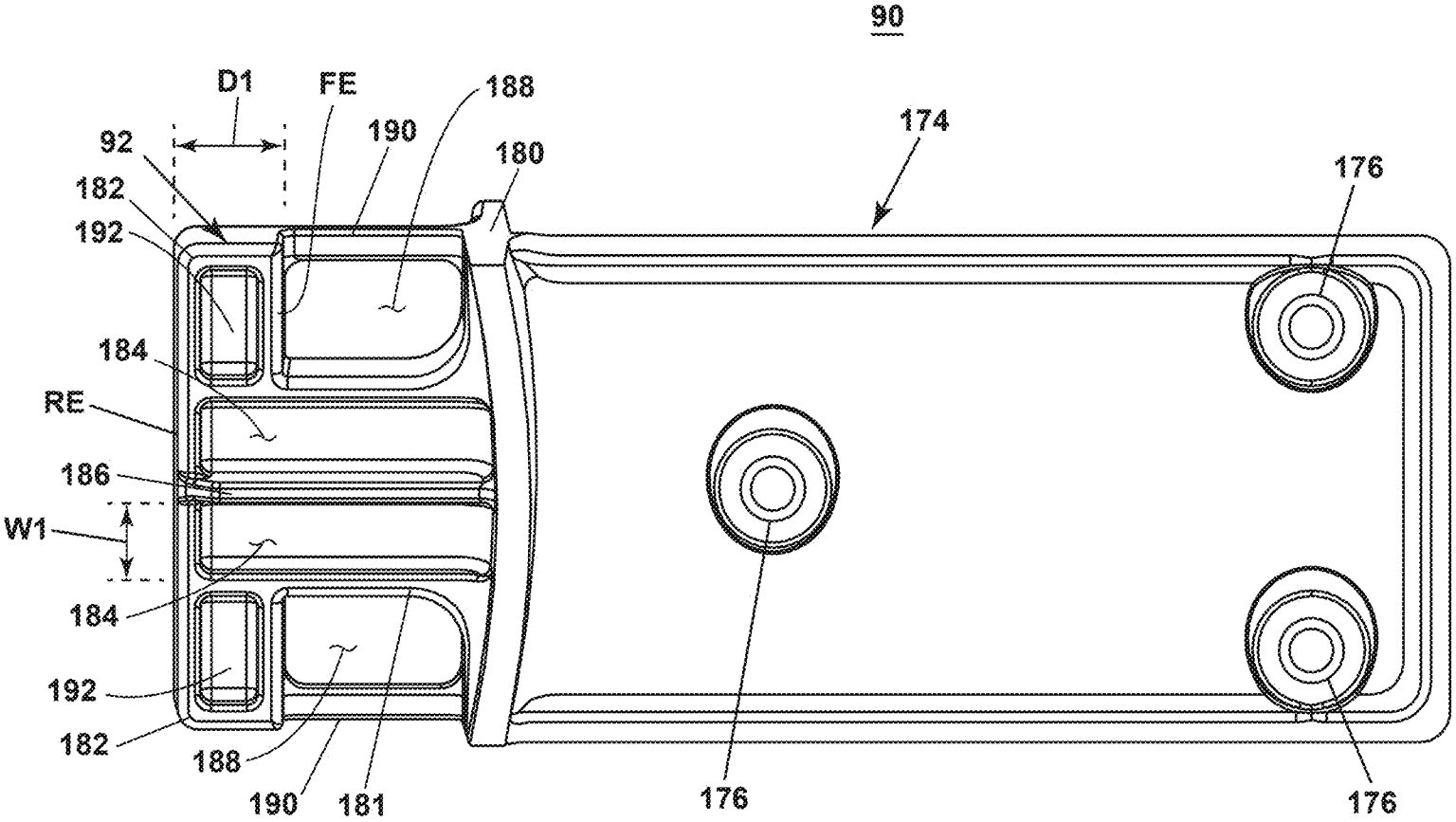
FIG. 11 is a top view of the root assembly.

Referring to FIG. 11, the leaves 182 and stem 181 form a rear edge RE while the leaves 182 form a forward edge FE. The distance of the leaves 182 between the forward edge FE and the rear edge RE define a dept, D1, which is slightly less than the axial dept of the notch 140. The channels 184 have a width, W1, that slightly greater than the width of the first spring fingers 116. The stem rib 186 is sized to be received within the alignment channel 118.

Figure 12:
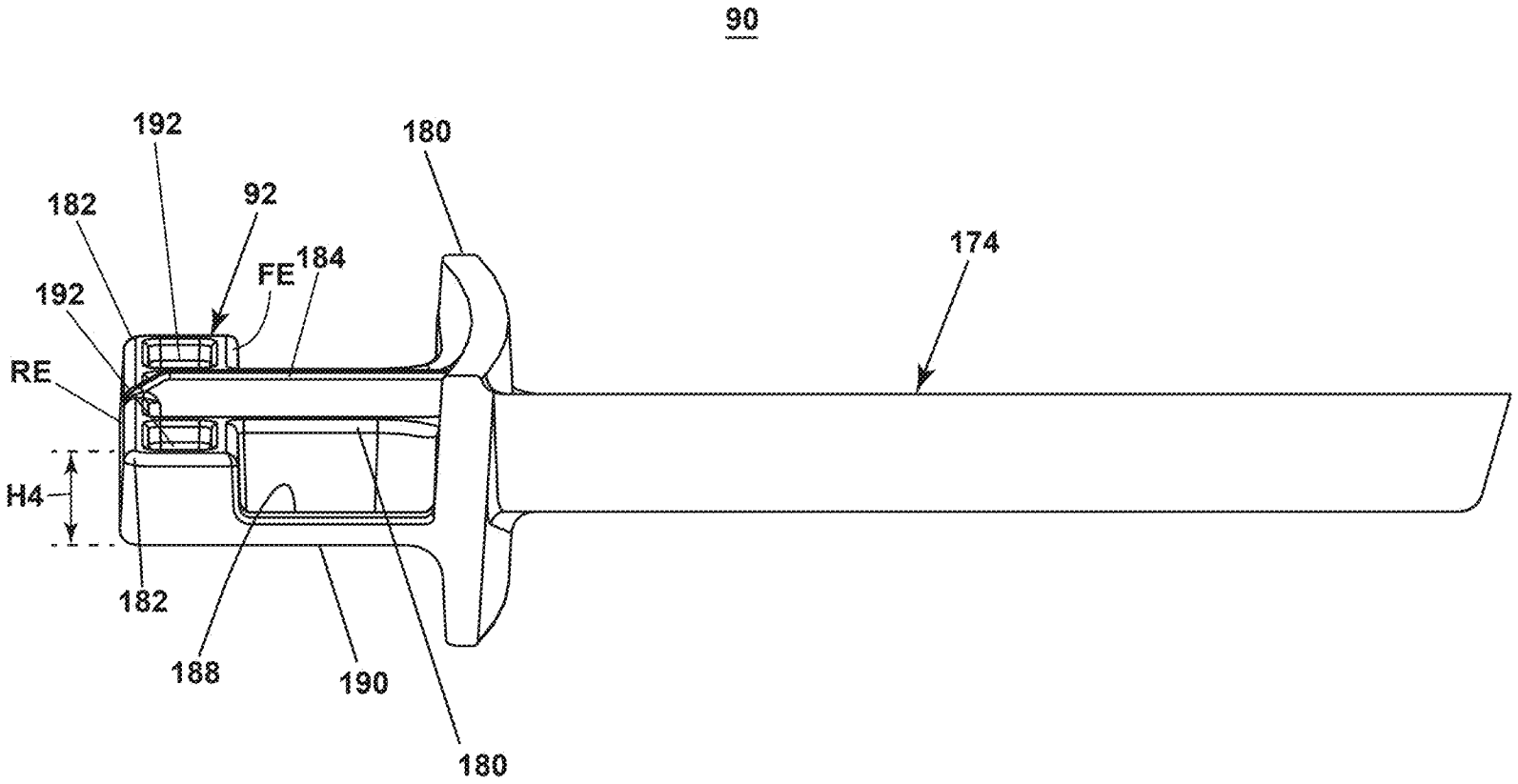
FIG. 12 is a side view of the root assembly.

Referring to FIG. 12, the leaves 182 have a height, H4, that is slightly less than the height H2. The height H4 is also the height of the rear edge RE.

The connection of one of the blade assembly to the rotor assembly will now be described relative to the insertion of the tab 92 into the pocket 86 at four informative insertion depts. For each insertion depth described, relative to the pocket 86, a first axial section view "A" will be taken through one of the spring fingers, a second axial section view "B" will be taken through one of the guide elements, and a top view "C" will be shown.

Figure 13A:
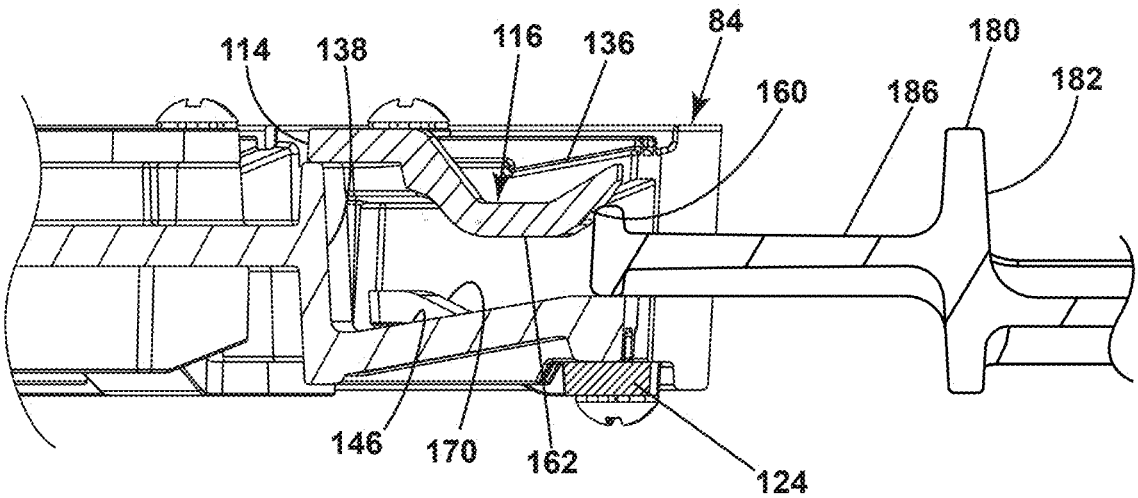
FIGS. 13A-C show the relative position of a tab from the root assembly with respect to a corresponding pocket at an initial insertion position.
Figure 13B:
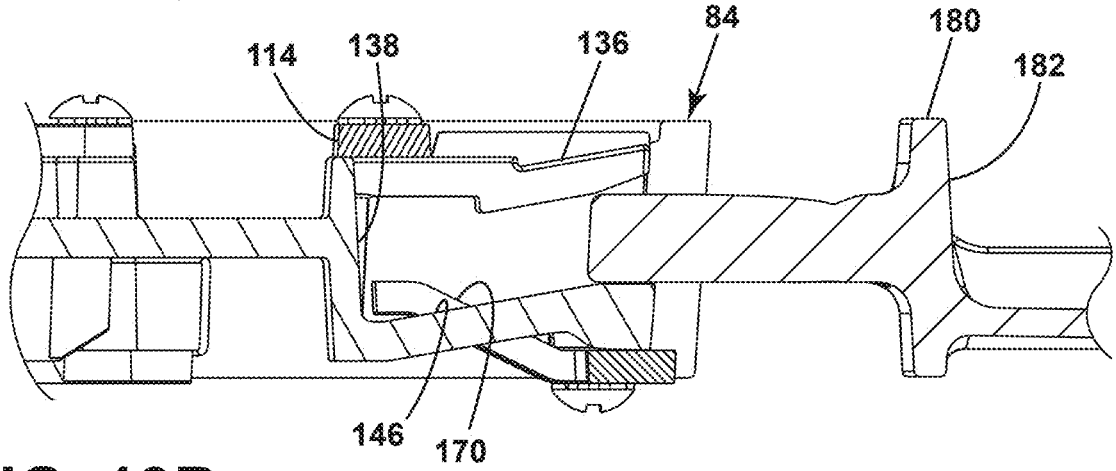
Figure 13C:
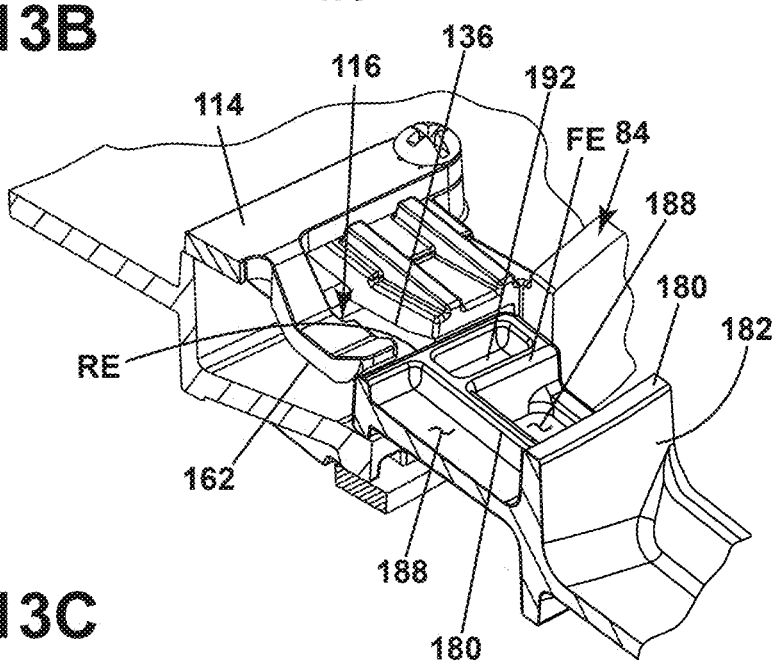

Referring to FIGS. 13A-C, initially, the tab 92 is aligned with the mouth 150 of the slot 88 and inserted until the rear edge RE of the tab 92 makes contact with the first ramp segment 160. Further insertion from this point will cause an upward deflection of the first spring fingers 116 and the person inserting the tab 92 will feel resistance from the deflection of the spring fingers.

Figure 14A:
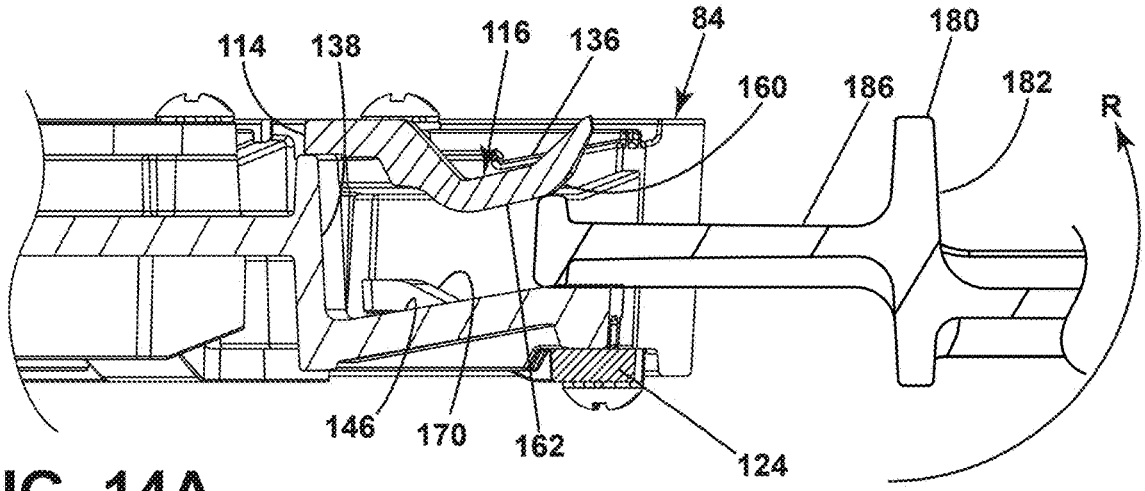
FIGS. 14A-C are similar to FIGS. 13A-C except that the tab is inserted further into the pocket.
Figure 14B:
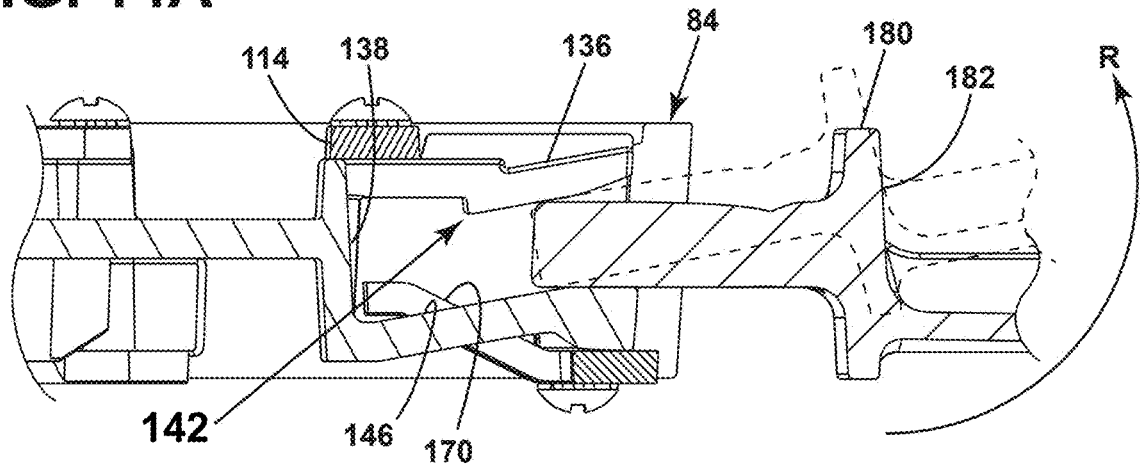
Figure 14C:
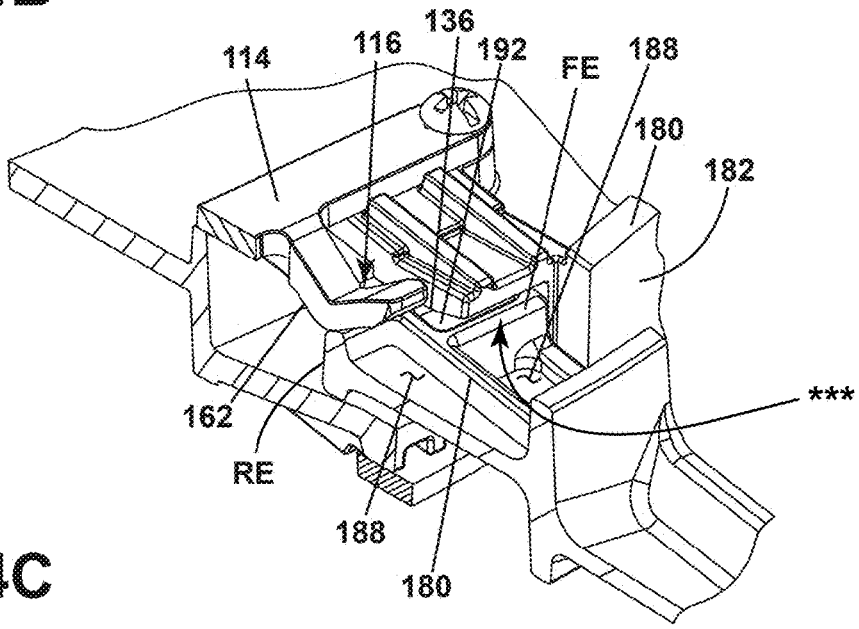
Figure 15A:
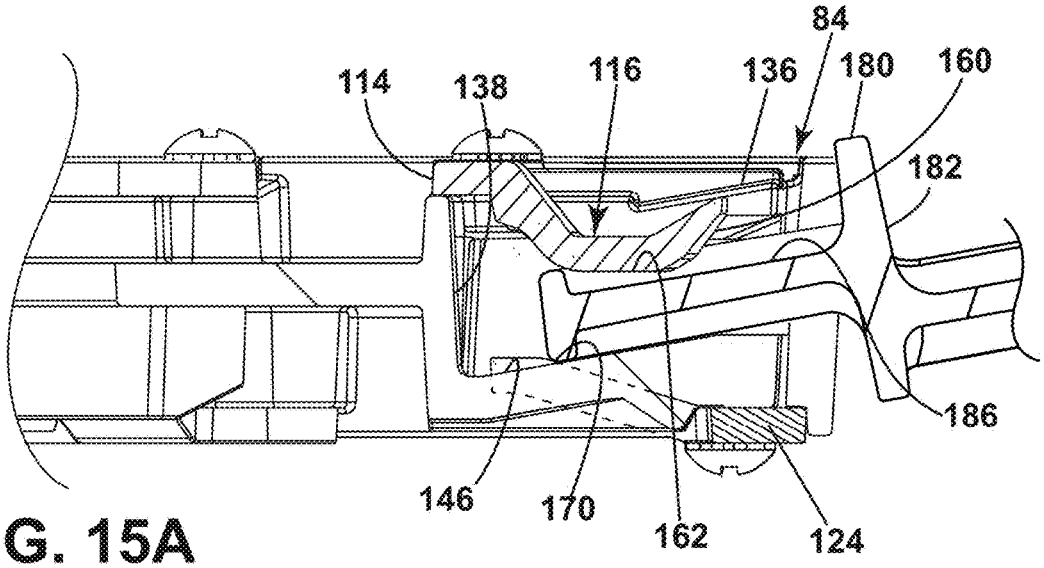
FIGS. 15A-C are similar to FIGS. 13A-C and 14A-C except that the tab is inserted further into the pocket.
Figure 15B:
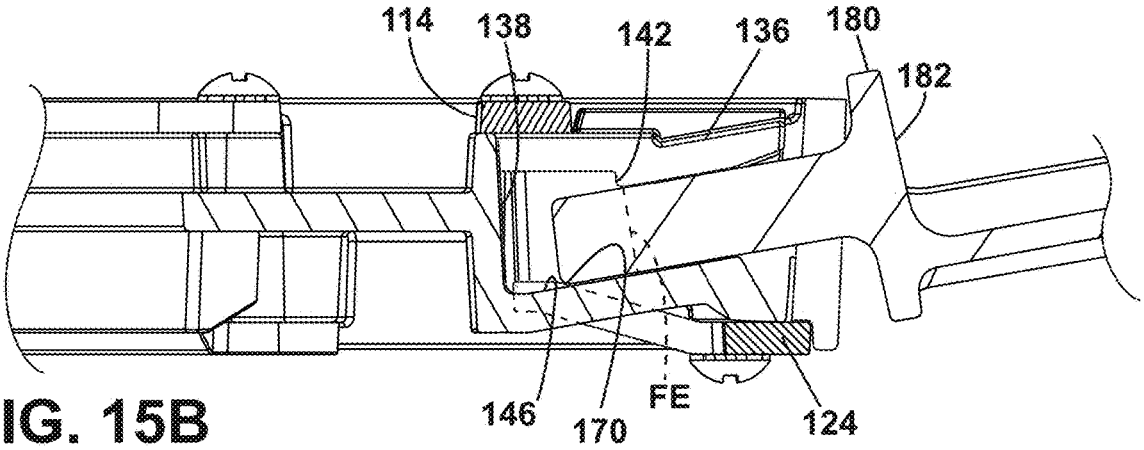
Figure 15C:
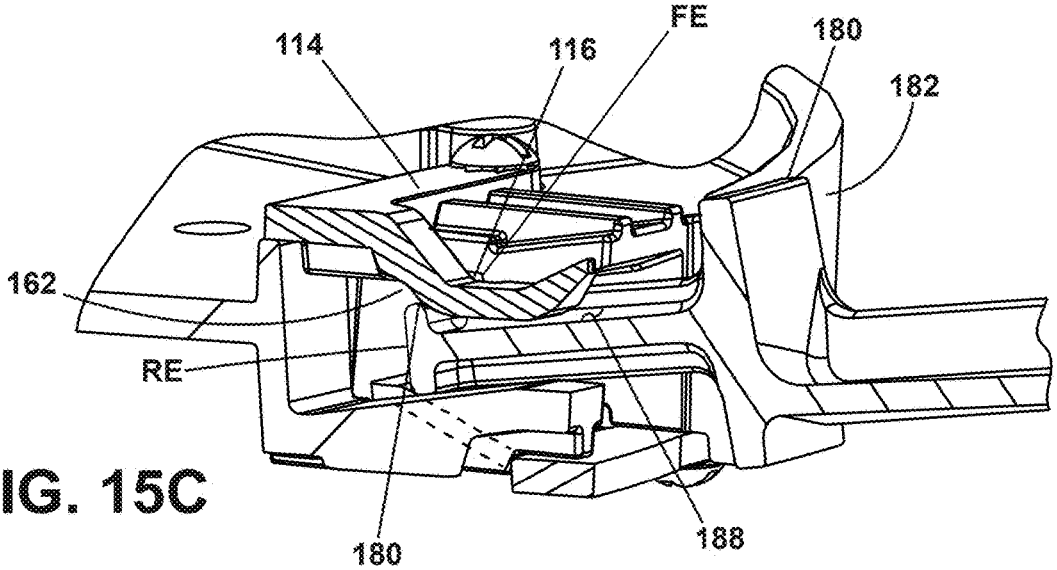

Referring to FIGS. 14A-C, the continued insertion of the tab 92 will lead to the upward deflection of the first spring fingers 116 to a point where the resistance from the first spring fingers 116 will encourage the user to rotate the tab 92 in the direction of arrow R until the tab 92 is roughly on the same angle alpha and aligned with the throat 152. The user can then insert the rotated tab 92 until the rear edge RE of the tab 92 contacts the third ramp segment 170 of the second spring fingers 126. Continued insertion will result in the second ramp segment 164 residing within the parallel channels 184 as is seen in FIGS. 15A-C, with the insertion continuing until approximately the forward edge FE is near, but not passed, the terminal end 142. In the position the lower end of the rear edge RE is near or starting to abut or press against the third ramp 170.

The continued insertion from the position shown in FIGS. 15A-C will lead to the forward edge FE (and edge 92) passing beyond the terminal end 142 of the first ramp 136.

During this part of the insertion, the lower end of the rear edge RE bears against the third ramp 170 of the lower spring fingers 126. At the point when the forward edge FE (and edge 92) clears the terminal end 142, the lower spring fingers 126 will bias the leaves 182 upward into the notch 140, which creates an audible sound and tactile click as feedback to the user.

Figure 16A:
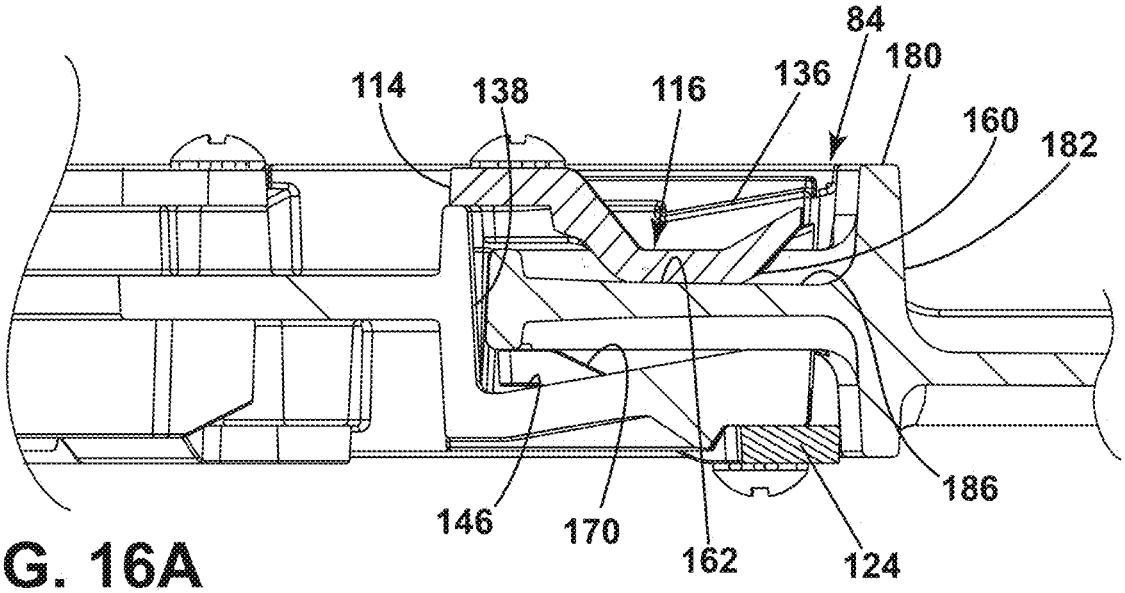
FIGS. 16A-C are similar to FIGS. 13A-C, FIGS. 14A-C, and FIGS. 15A-C except the tab is fully inserted in the pocket.
Figure 16B:
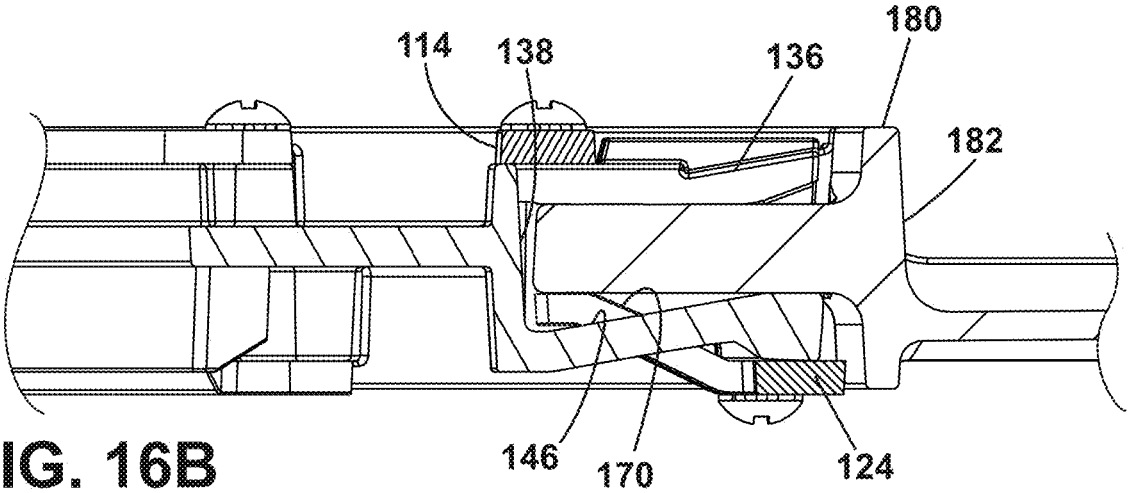
Figure 16C:
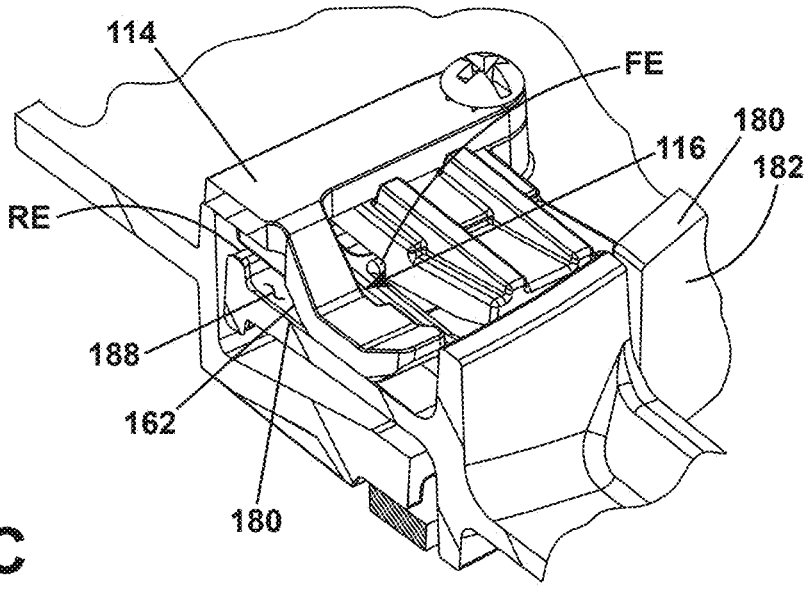

This insertion also permits rotation in a direction opposite the direction R and brings the upper end of the rear edge RE into contact with the rear wall 138 of the notch 140 and the lower end of the rear edge RE rides up the third ramps 170 and settles on the landings 172, with the rear edge RE adjacent to or abutting with the rear wall 138 of the notch 140. This position is shown in FIGS. 16A-C and is the final or fully inserted position.

In this final position, there are several forces acting on the tab 92 to place the tab 92 under tension. The first spring fingers 116 are applying a biasing force to the bottom of the channels 184. The lateral extensions 168 of the first spring fingers 116 are also bearing against the outside of the channels 184. The second spring fingers are applying a biasing force to the lower side of the tab 92 which holds the upper side of the tab 92 against the interior of the notch 140. These forces resist the up/down movement of the blade associated with the weight of the blade and/or aerodynamic lift of the blade, as well as the angular movement of the blade in response to rotation. The abutting relationship between the lateral extensions and the outside of the channels 184 resist the relative rotation of the tab 92 within the pocket about an axis parallel to the axis of rotation of the fan. Similarly, the rear edge RE is abutting or close to the rear wall 138 of the notch, which further limits the rotation of the tab 92 within the pocket. Thus, the blade is kept under tension in all conditions.

To remove the blade after it is inserted to the final position, the user must rotate the blade in a direction opposite the direction R, which will deflect the second spring fingers 126. At some point in the rotation, the forward edge FE will drop below the terminal end 142 of the first ramp 136. At this point, the user can axially pull on the fan blade with sufficient force to deflect the first spring fingers 116 up over the forward edge FE and permit the axial removal of the tab 92 and removal of the fan blade.

It should be noted that while the tab 92 is illustrated as being part of the blade and the pocket 86 is part of or connected to the rotor assembly 42, it is contemplated that the tab 92 and pocket 86 can be reversed in their locations. In such a reversal, the blades would carry the pocket and the rotor assembly would carry the tabs.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan assembly for mounting to a structure, the ceiling fan assembly comprising:

a motor having a rotor assembly, which rotates about a rotational axis, and a stator assembly that is stationary relative to the rotational axis;

at least one blade assembly having a root assembly; and a connector assembly comprising:

a pocket located within the rotor assembly, a tab carried by the at least one blade assembly and received within the pocket, a first ramp and a second ramp in opposing relation within the pocket to define a throat within the pocket, with the throat oriented at an angle relative to the pocket, a first tensioner and a second tensioner in opposition relative to the pocket and bearing against the tab, when it is received within the pocket, such that the first tensioner applies a first pressure to the tab and the second tensioner applies a second pressure to the tab.

2. The ceiling fan assembly of claim 1 wherein the first tensioner comprises at least one first spring finger, the tab comprises at least one channel, and the at least one first spring finger is biased against a floor of the channel to apply the first pressure, and the at least one first spring finger abuts a side of the channel to apply the second pressure.

3. The ceiling fan assembly of claim 2 wherein the at least one first spring finger comprises a pair of first spring fingers and the at least one channel comprises a pair of corresponding channels, with one of the first spring fingers received in a corresponding one of the channels.

4. The ceiling fan assembly of claim 3 wherein the pair of channels are separated by a rib and the pair of first spring fingers are separated by an alignment channel receiving the rib.

5. The ceiling fan assembly of claim 4 wherein the pair of first spring fingers abut the rib.

6. The ceiling fan assembly of claim 2 wherein at least one first spring finger has a width that is commensurate with a width of the at least one channel.

7. The ceiling fan assembly of claim 6 wherein the at least one first spring finger comprises a lateral extension defining the width.

8. The ceiling fan assembly of claim 2 wherein the second tensioner comprises at least one second spring finger bearing again the tab to apply the second pressure.

9. The ceiling fan assembly of claim 8 wherein the at least one second spring finger abuts the tab at a location deeper within the pocket than where the at least one first spring finger abuts the tab.

10. The ceiling fan assembly of claim 9 wherein the at least one first spring finger and the at least one second spring finger abut opposite sides of the tab.

11. The ceiling fan assembly of claim 10 wherein the tab comprises at least one channel and the at least first spring finger abuts a floor of the at least one channel to apply the first pressure.

12. The ceiling fan assembly of claim 11 wherein the at least one first spring finger abuts a wall of the channel to apply the second pressure.

13. The ceiling fan assembly of claim 12 wherein the at least one first spring finger has a portion with a width commensurate with a width of the channel to apply the second pressure.

14. The ceiling fan assembly of claim 8 wherein the at least one second spring finger comprises a pair of spaced seconding spring fingers defining a spring finger gap therebetween, and the at least one first spring finger comprises a pair of spaced first spring fingers that overly the spring finger gap.

15. The ceiling fan assembly of claim 1 further comprising a first guide and a second guide in opposing and spaced relationship to define a mouth, a throat, and a notch for the pocket.

16. The ceiling fan assembly of claim 15 wherein the second pressure applied by the second tensioner biases the tab into the notch for a snap-fit connection.

17. The ceiling fan assembly of claim 16 wherein a location of the application of the second pressure is located deeper in the pocket than the location of the application of the first pressure.

18. The ceiling fan assembly of claim 17 wherein the second guide and the second tensioner define a floor for the pocket, with the tab resting on the floor when inserted within the pocket.

19. The ceiling fan assembly of claim 18 wherein a portion of the tab is received in the notch when the tab is inserted within the pocket.

20. The ceiling fan assembly of claim 19 wherein the first tensioner applies the first pressure and the second pressure.

21. The ceiling fan assembly of claim 1 wherein the first ramp, the second ramp, the first tensioner, the second tensioner, and the tab are arranged such that the tab is first inserted through the throat at an angle relative to the pocket and then the tab is rotated against at least one of the first and second pressures into a fully inserted position.

22. The ceiling fan assembly of claim 1 wherein the first tensioner has a portion extending into the pocket.

23. The ceiling fan assembly of claim 22 wherein the second tensioner has a portion extending into the pocket.

24. The ceiling fan assembly of claim 1 wherein the first pressure is in opposition to the second pressure.

25. The ceiling fan assembly of claim 1 wherein the first ramp and second ramp have opposing and parallel surfaces defining the throat.

26. The ceiling fan assembly of claim 1 further comprising a landing extending from the second ramp and at least partially defining a mouth for the pocket.

27. The ceiling fan assembly of claim 1 wherein the first ramp and second ramp at least partially define a notch for the pocket.

* * * * *